US005427239A

United States Patent [19]

Hunt

[11] Patent Number: 5,427,239

[45] Date of Patent: Jun. 27, 1995

[54] FLEXIBLE MULTIPANEL TOOL POUCH

[76] Inventor: John F. Hunt, P.O. Box 1511, Park City, Utah 84060

[21] Appl. No.: 225,155

[22] Filed: Apr. 8, 1994

[51] Int. Cl.[6] ..... B65D 85/20; A45C 13/00

[52] U.S. Cl. ..... 206/372; 190/125; 383/16; 383/39; 383/113; 383/117

[58] Field of Search ..... 206/372, 373; 383/39, 383/16, 26, 113, 117

[56] References Cited

U.S. PATENT DOCUMENTS

| | | | |
|---|---|---|---|
| 1,679,101 | 7/1928 | Sternthal | 206/372 X |
| 2,441,415 | 5/1948 | Hoishman | 383/39 |
| 2,473,429 | 6/1949 | Hinne | 383/39 X |
| 4,306,367 | 12/1981 | Otto | 428/43 X |
| 4,682,691 | 7/1987 | Spienng | 206/373 |
| 4,685,570 | 8/1987 | Medow | 383/39 X |
| 4,715,499 | 12/1987 | Franklin | 206/373 |
| 4,736,853 | 4/1988 | O'Mara | 206/372 X |
| 4,738,547 | 4/1988 | Brown | 383/39 |
| 4,901,464 | 2/1990 | Banoun | 206/373 X |
| 5,002,401 | 3/1991 | Blackman | 206/372 X |
| 5,139,143 | 8/1992 | Pond | 206/373 |

*Primary Examiner*—Bryon P. Gehman
*Attorney, Agent, or Firm*—Workman, Nydegger & Seeley

[57] ABSTRACT

A flexible tool pouch having a plurality of elongated pockets securely positioned adjacent to each other. Each pocket has an inside liner made of woven nylon, an outside liner made of acrylic pile, and an open end for receiving a tool. Extending from the open end of the connected pockets is a hood made of acrylic pile that can be partially folded over the tools. Also positioned on the tool pouch are eyelets, handle straps, and a securing strap.

19 Claims, 3 Drawing Sheets

FLEXIBLE MULTIPANEL TOOL POUCH

BACKGROUND

1. Field of the Invention

The present invention relates generally to flexible tool pouches. More specifically, the present invention relates to durable, flexible tool pouches for use in carrying, storing and protecting hand tools.

2. Background Art

Mechanics and craftsmen are spending ever increasing amounts on sophisticated and highly refined hand tools. To protect their investment from damage and loss while simultaneously trying to keep them clean, various types of tool kits or tool holders have been developed. Traditionally, tools have been kept in a conventional tool box. A tool box, however, does not prevent abrasion between the tool which can scratch or break the tools nor does a tool box assist in keeping the tools clean.

To improve protection of the tools and to keep them in an organized fashion, various tool bags have been designed. A conventional tool bag comprises a plurality of pockets. Each pocket is designed to receive an individual tool. The tool bag is typically made of a soft, flexible cotton or wool material that absorbs grease and dirt from the tools to help keep them clean. When the tools are not needed, the tool bag can be rolled up for transportation or storage.

Although the tool bags help to prevent direct contact between the tools and aid in keeping the tools clean, certain drawbacks have been encountered. The cotton and wool material that the bags are made of have minimal durability. Under the repeated use and rough conditions associated with mechanics and craftsmen, the bags quickly wear out. Furthermore, although the tool bags can be machine washed to remove the dirt and grease, they can not be washed in the same solvent used to clean the tools. The application of the solvent to the tool bags decomposes the material used. Accordingly, the tools must be cleaned separately from the tool bags.

Plastic and leather tool bags have also been used but provide their own drawbacks. Although plastic and leather tool bags have extended durability, they are difficult to wash in that the grease and dirt can not escape through the walls of the bag. Furthermore, plastic and leather also has a negative effect when washed in tool cleaning solvent.

There are also other universal problems associated with conventional tool bags. Tool bags containing a large number of tools can have a large diameter when rolled up. Such bags can be difficult to carry. Furthermore, although the tool bags can be rolled out into a horizontal position, the tools would often be more accessible if they were displayed in a vertical orientation.

BRIEF SUMMARY AND OBJECTS OF THE INVENTION

It is therefore an object of the present invention to provide a tool pouch that prevents tools from abrading against one another or other objects.

Another object of the present invention is to provide a tool pouch as defined above that will help clean the tools.

It is also an object of the present invention to provide a tool pouch that is durable over extended use.

Yet another object of the present invention is to provide a tool pouch that can be washed in the same solvent as the tools.

Still another object of the present invention is to provide a tool pouch that can be easily carried when filled with tool.

Also another object of the present invention is to provide a tool pouch that can display the tools held in the pouch in a vertical position.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein a flexible tool pouch intended for use in carrying, storing, and protecting hand tools is provided. The tool pouch comprises a plurality of elongated pockets securely positioned adjacent to each other. Each pocket has an open end, a closed end, an inside liner made of woven nylon, and an outside liner made of acrylic pile.

Folded over the mouth end of each pocket is a pocket trim preferably made of nylon webbing. The pocket trim helps protect the pocket end and makes it easier for inserting tools. A surprising result of making the tool pouch out of woven nylon, acrylic pile, and nylon webbing is that the tool pouch can be washed in the same solvent as the tools without damage to the tool pouch.

In the preferred embodiment, the pockets are arranged in incrementally increasing lengths to conveniently hold tools of different lengths. The pockets can, however, be a uniform length. In an alternative embodiment, a row of secondary pockets can be attached to the surface of the initial pockets.

Extending from the open end of the pockets is a hood ending in a cover edge. The hood is made of acrylic pile and preferably has a length sufficient to permit the cover edge to be folded over the head of the longest tool positioned within pockets. In such a design, the hood acts as a stop to prevent other tools from falling out when the tool pouch is closed.

The tool pouch is further designed with means for hanging the tool pouch in a vertical position. An example of one such means is the positioning eyelets near the cover edge of the hood. Such eyelets can be used to tie the tool pouch to an adjacent member.

Means for securing the tool pouch in the closed position are also provided. Such means include a VELCRO® strap or tieing strings attached to the tool pouch. Finally, means for holding the tool pouch are provided. The holding means can include handles made of nylon webbing being attached to opposing sides of the tool pouch.

BRIEF DESCRIPTION OF THE DRAWINGS

In order to completely understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Figure 1:
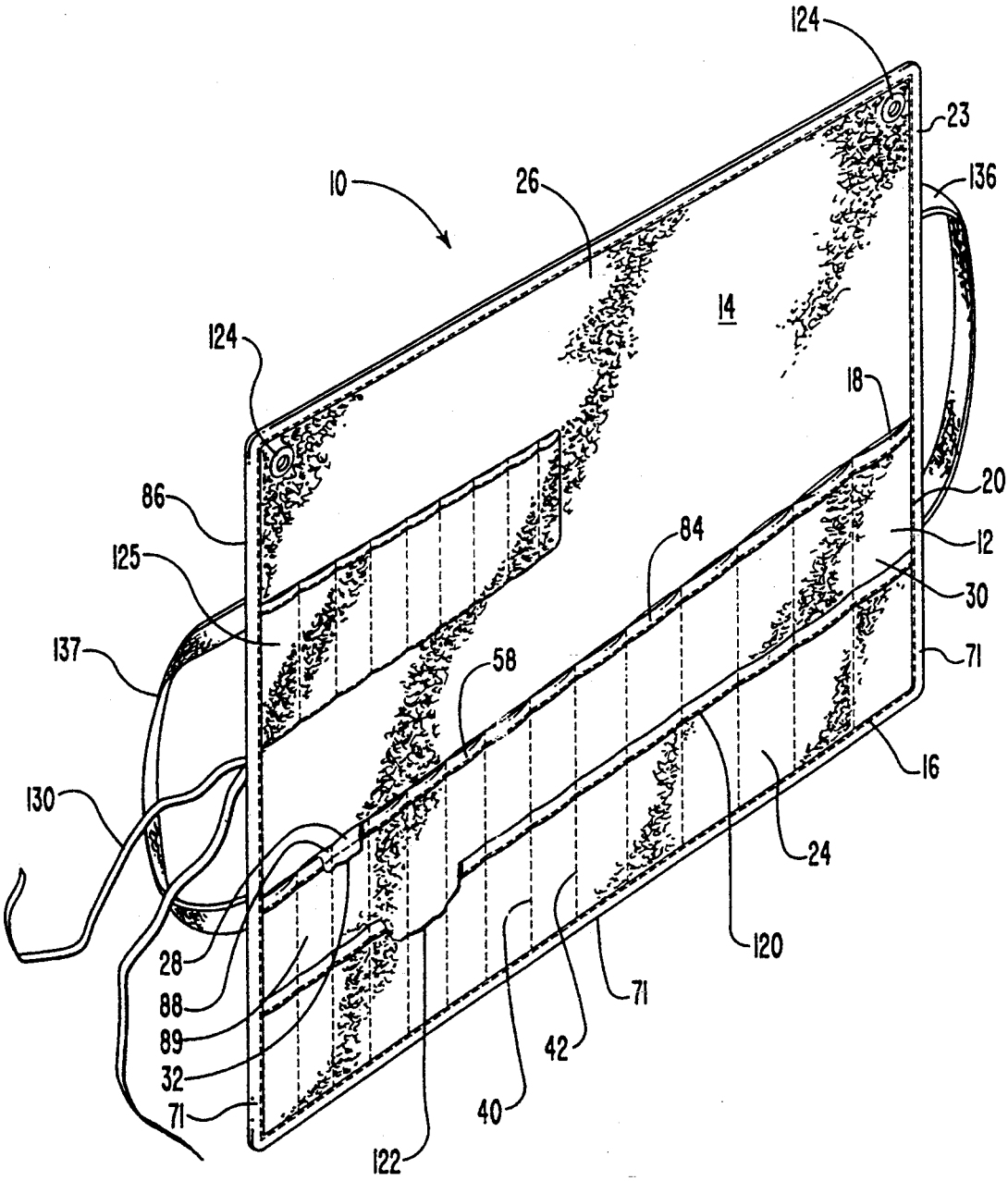
FIG. 1 is a front view of a tool pouch having pockets and a hood.

Depicted in FIG. 1 is a flexible tool pouch 10 intended for use in carrying, storing, and protecting hand tools (not shown), particularly wrenches. Tool pouch 10 comprises a plurality of elongated pockets 12 and a hood 14 that can be draped over the tools. Each pocket 12 is defined by an closed end 16, an open end 18, and sides 20. The corresponding width and height for each pocket 12 can be selectively designed depending on the shape and length of the tool to be stored. For example, as shown in FIG. 1, each pocket 12 incrementally increases in length while also increasing in width. It is also conceivable that the width of pocket 12 could vary along sides 20 to accommodate uniquely shaped tool.

Hood 14 is defined by a cover edge 21 and sides 23 that extends between open end 18 of pockets 12 and cover edge 21. It is self evident that the height of sides 23 of hood 14 vary in relation to the height of pockets 12. The ultimate length of sides 23, however, is dependent on the length of the tool being stored. In the preferred embodiment, sides 23 should be sufficient so that when tools are positioned in pockets 12, cover edge 21 can at least be folded over the head of the longest tool and preferably cover all exposed portions of the tools. Such a design not only helps to protect the heads of the tools but also acts as a block so that once tool pouch 10 is rolled up, tools cannot slide out of tool pouch 10.

To increase the capacity of tool pouch 10, a plurality of secondary pockets 24 can be positioned adjacent to pockets 12. Secondary pockets 24 can have the same features as pockets 12 except that their length should be shorter than the length of pockets 12 to enable access to pockets 12. Using the same approach, it is possible to continue to add rows of pockets until a desired quantity is obtained.

Figure 2:
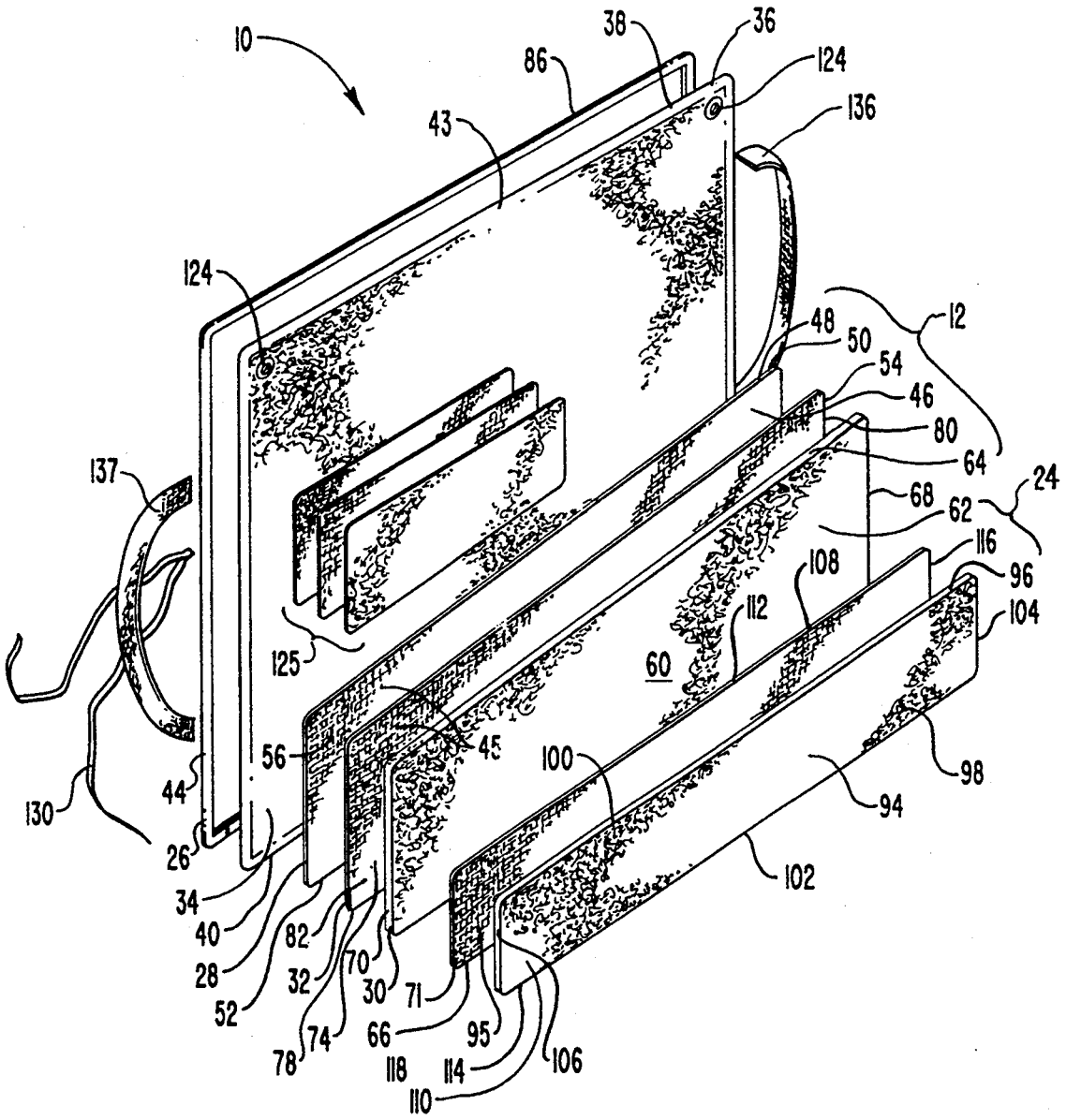
FIG. 2 is an exploded view of the tool pouch in FIG. 1.

One of the novel features of the present invention is the material and orientation of the materials used to produce tool pouch 10. Depicted in FIG. 2 is an exploded view of the layers of materials used to produce tool pouch 10. The fundamental layers of tool pouch 10 include back panel 26, back panel liner 28, front panel 30, and front panel liner 32. Although back panel 26 can be designed in any desired shape, e.g. square, circular, triangular, back panel 26 is depicted in the preferred embodiment as being rectangular. Back panel 26 is shown having an interior surface 34, an exterior surface 36, a top edge 38, a base edge 40, an interior edge 42 and an outside edge 44. Edges 38, 40, 42, and 44 define an outside perimeter 43.

Back panel 26 is made of acrylic pile. There are over 100 different types of acrylic pile that can be purchased from Maldenmills of Laurance, Mass. depending on the desired strength, thickness, and durability desired. One preferred type of acrylic pile is Polar Fleece ® or Polar Plus ® sold by Patagonia. Some of the benefits of using acrylic pile is that it is soft and can be produced in a desired thicknesses for padding. These features help protect tools from damage by abrasion and impact from other tools and objects.

Another benefit of using acrylic pile is that, similar to cotton, acrylic pile acts to absorb grease and clean dirt from the tools. A surprising result, however, unlike cotton, is that acrylic pile is not damaged when placed in conventional solvents used to clean tools. Accordingly, the use of acrylic pile allows one to simultaneously clean the desired tools and acrylic pile with a single solvent.

Although acrylic pile is typically more durable than most cotton and wool materials, back panel liner 28 is secured against back panel 26 to increase the durability of tool pouch 10. Back panel liner 28 forms an inside wall 45 for pockets 12 and is made of an abrasion resistant woven nylon. The preferred woven nylon is Cordura ®. Cordura ® fibers can be purchased from Du Pont in three different types: 440, 710, and COR, type 440 being the most preferred. Cordura ® fabric can be purchased from conventional fabric stores.

Woven nylon has the benefit of being soft to prevent scratching or damaging of the tools while at the same time being extremely durable to prevent ware of tool pouch 10. Furthermore, woven nylon has the surprising result of being washable in tool cleaning solvents without being damaged.

In the preferred embodiment, back panel liner 28 is shown having an interior surface 46, an exterior surface 48, a mouth edge 50, a base edge 52, an inside edge 54, and an outside edge 56. In alternative embodiments, such as where the tool pouch is circular, the edges would have to be redefined. Back panel liner 28 is properly positioned by aligning base edges 52 and 40, inside edges 54 and 42, and outside edges 56 and 44 of back panel liner 28 and back panel 26, respectively. Outside edge 56 is longer than inside edge 54 of back panel liner 32 to permit incrementally increased lengths of pockets 12.

Alternatively, edges 56 and 54 can be the same height when producing pockets 12 of a uniform size. In either embodiment, however, it is preferred that edges 56 and 54 of back panel liner 28 be shorter than edges 42 and 44 of back panel 26 to permit the formation of hood 14. Back panel liner 28 can be secured to back panel 26 by any conventional means used to secure material together, e.g., stitching or gluing.

Also depicted in FIG. 2 are front panel 30 and front panel liner 32 each having a shape complementary to back panel liner 28. Front panel 30 is defined by an interior surface 60, an exterior surface 62, a mouth edge 64, a base edge 66, an inside edge 68, and an outside edge 70. Base edge 66, inside edge 68, and outside edge 70 combine to form attachment edge 71. As used in the specification and appended claims, the term "attachment edge" is intended to include all edges on front panel 30 except the edge defining opened end 18 of pockets 12.

Front panel liner 32 is defined by an interior surface 72, an exterior surface 74, a mouth edge 76, a base edge 78, an inside edge 80, and an outside edge 82. Exterior surface 74 of front panel liner 32 is attached to interior surface 72 of front panel 30 in a complementary fashion so that all the edges are aligned.

Front panel 30 is then aligned with and attached to back panel liner 28 so that pocket 12 is formed having inside walls 45 defined by interior surface 72 of front panel liner 32 and interior surface 46 of back panel liner 28. Attachment is accomplished by stitching (or using other conventional means) attachment edge 71 to corresponding edges on back panel 26.

To protect mouth edge 64 and mouth edge 76, a pocket trim 84 is folded over and secured to edges 64 and 76. Pocket trim 84 is made of nylon webbing that can be purchased at climbing or fabric stores. With front panel 30 attached to back panel 26, an edge trim 86 can also be attached to tool pouch 10. Edge trim 86 is made of nylon webbing and is folded and secured over top of back panel 26 and front panel 30 about outside perimeter 43.

A plurality of pockets 12 be formed by inserting stitching walls 90 that extend from pocket trim 84 to base edge 40 of back panel 26 at selected increments along base edge 40. Stitching walls 90 are formed by stitching a thread 92 that penetrates through back panel 26, back panel liner 28, front panel 30, and front panel liner 32.

As used in the specification and appended claims, front panel liner 32 and back panel liner 28 define an inside liner 88 of pockets 12. Furthermore, back panel 26 and front panel 30 define an outside liner 89 of pocket 12.

In one embodiment, as shown in FIG. 1, tool pouch 10 can be formed with secondary pockets 24. As further shown in FIG. 2, secondary pockets 24 are made by attaching a secondary panel 94 and a secondary panel liner 95 to exterior surface 62 of front panel 30. As with the previous layers, secondary panel 94 is defined by an interior surface 96, an exterior surface 98, a mouth edge 100, a base edge 102, an inside edge 104, and an outside edge 106. Secondary panel liner 95 is defined by an interior surface 108, an exterior surface 110, a mouth edge 112, a base edge 114, an inside edge 116, and an outside edge 118.

Secondary panel 94 is formed with base edge 102 being complementary to base edge 66 of front panel 30. However, inside edge 104 and outside 106 of secondary panel 94 are formed shorter than inside edge 68 and outside edge 70 of front panel 30, respectively. This design permits easy access to pockets 12 without interference by secondary pockets 24.

Secondary panel liner 95 is formed with a shape complementary to secondary panel 94. Secondary pockets 24 are then formed by positioning exterior surface 110 of secondary panel liner 95 in complementary alignment with interior surface 96 of secondary panel 94. A secondary pocket trim 120, made of nylon webbing, is then folded over and secured to adjacent mouth edge 100 and mouth edge 112. The combined secondary panel 95 and secondary panel liner 94 are then aligned with and secured against front panel 30 by stitching base edge 102, inside edge 104 and outside edge 106 of secondary panel 94 to base edge 66, inside edge 68, and outside edge 70 of front panel 30, respectively. Secondary pocket 24 is thus formed having an inside wall 122 defined by interior surface 108 of secondary panel liner 95 and exterior surface 62 of front panel 30.

As with pockets 12, a plurality of secondary pockets 24 can be formed by positioning stitching walls 90 that extend from secondary pocket trim 120 to base edge 40 of back panel 26 at selected increments along base edge 40.

As depicted in FIG. 1, additional pockets 125 can be positioned on hood 14. Additional pockets 125 can be formed in the same manner and materials as pockets 12.

As a result of back pocket 26 being made of acrylic pile, exterior surface 36 of back panel 26 (see FIG. 3) provides a soft, smooth surface of positioning tool pouch 10. That is, tool pouch 10 can be laid out on car hoods, windows and other delicate surfaces without fear of tool pouch 10 damaging the adjacent surface. Furthermore, tool pouch 10 acts as a pad on which other tools or articles can be laid so as not to damage the adjacent surface.

Figure 3:
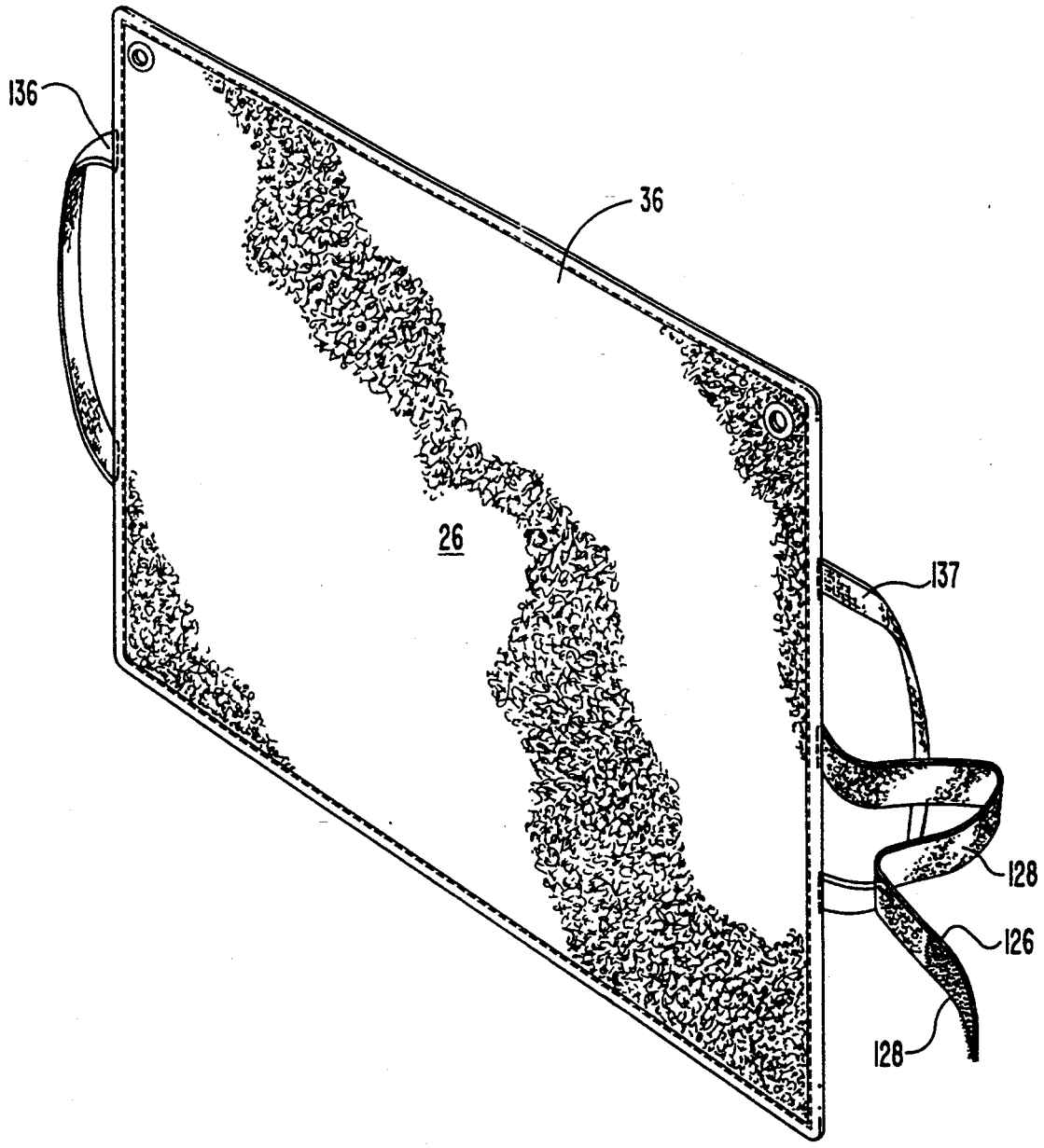
FIG. 3 is a back view of the tool pouch in FIG. 1, the tool pouch having a VELCRO ® strap and nylon webbing handle.

In accordance with the present invention, there is also provided means for hanging tool pouch 10 in a vertical position. By way of example and not by limitation, there is shown in FIG. 3 eyelets 124 positioned on back panel 26. Eyelets 124 are preferably positioned near top edge 38 and can be used for attaching tool pouch 10 to adjacent objects. Alternative means for hanging tool pouch 10 include hooks or straps that can be attached to back panel 26.

In accordance with the present invention, there is also provided means for securing tool pouch 10 in the closed position. Tool pouch 10 is closed by folding hood 14 over the head of the tools (not shown) and, starting with inside edge 42, rolling tool pouch 10 into a cylindrical shape. By way of example and not by limitation, as shown in FIG. 3, means for securing tool pouch 10 includes a VELCRO® strap 126 attached to back panel 28. VELCRO® strap 126 is capable of wrapping around closed tool pouch 10 and holding tool pouch 10 closed by engagement of VELCRO® pads 128. Alternative means for securing tool pouch 10 includes a pair of ties 130 as shown in FIG. 1.

Finally, in accordance with the present invention, there is also provided means for holding tool pouch 10. By way of example and not by limitation, there is shown in FIG. 3 an inside handle strap 136 secured to inside edge 42 of back panel 26 and an outside handle strap 137 attached to outside edge 44 of back panel 26. Handle straps 136 and 137 can be made of a variety of materials including nylon webbing.

The positioning of handle straps 136 and 137 permit tool pouch 10 to be conveniently carried in both the opened and closed position. In the open position, handle straps 136 and 137 can be simultaneously grabbed to form a sling in which other tools and articles can be carried. In the closed position, outside hand strap 137 will still be exposed for carrying tool pouch 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A flexible tool pouch for use in carrying, storing, and protecting hand tools, the flexible tool pouch comprising:

a) a flexible back panel made of acrylic pile, the back panel having an interior surface and an exterior surface;

b) a flexible back panel liner made of woven nylon, the back panel liner being secured to a portion of the interior surface of the back panel;

c) a flexible front panel liner made of woven nylon, the front panel liner being aligned with and positioned adjacent to the back panel liner; and d) a flexible front panel made of acrylic pile, the front panel having an interior surface, an exterior surface, an attachment edge and a mouth edge, the interior surface of the front panel being secured to the front panel liner and the attachment edge being secured to the back panel, thereby forming a pocket having walls defined by the front panel liner and the back panel liner, the pocket having an opening formed between the mouth edge of the front panel and the back panel.

2. A flexible tool pouch for use in carrying, storing, and protecting hand tools as defined in claim 1, wherein the front panel is secured to the back panel along a line extending from the mouth edge to the attachment edge, thereby bisecting the pocket.

3. A flexible tool pouch for use in carrying, storing, and protecting hand tools as defined in claim 1, wherein the front panel is secured to the back panel along a plurality of lines extending from the mouth edge to the attachment edge, thereby forming the pocket into a plurality of pockets.

4. A flexible tool pouch for use in carrying, storing, and protecting hand tools as defined in claim 1, further comprising means for hanging the tool pouch, the hanging means being secured to the back panel.

5. A flexible tool pouch for use in carrying, storing, and protecting hand tools as defined in claim 4, wherein the means for hanging the tool pouch comprises at least one eyelet.

6. A flexible tool pouch for use in carrying, storing, and protecting hand tools as defined in claim 1, further comprising means for securing the tool pouch in a closed position, the securing means being attached to the back panel.

7. A flexible tool pouch for use in carrying, storing, and protecting hand tools as defined in claim 6, wherein the means for securing the tool pouch comprises hook & loop.

8. A flexible tool pouch for use in carrying, storing, and protecting hand tools as defined in claim 1, further comprising means for holding the tool pouch.

9. A flexible tool pouch for use in carrying, storing, and protecting hand tools as defined in claim 8, wherein the means for holding the tool pouch includes a back panel having opposing sides with a handle strap positioned on each opposing side.

10. A flexible tool pouch for use in carrying, storing, and protecting hand tools as defined in claim 1, further comprising:

a) a secondary panel liner made of woven nylon, the secondary panel being secured to the exterior surface of the front panel; and b) a secondary panel made of acrylic pile, the secondary panel having an interior surface, an exterior surface, an attachment edge and a mouth edge, the interior surface of the secondary panel being secured to the secondary panel liner and the attachment edge being secured to the front panel, thereby forming a secondary pocket having walls defined by the front panel and the secondary panel liner, the secondary pocket having an opening formed between the mouth edge of the secondary panel and the front panel.

11. A flexible tool pouch for use in carrying, storing, and protecting hand tools, the flexible tool pouch comprising:

a) a plurality of elongated pockets securely positioned adjacent to each other, each pocket having:

i) an open end, ii) a closed end positioned opposite the open end, iii) an inside liner made of woven nylon, and iv) an outside liner made of acrylic pile; and b) a hood extending a distance from the open end of the pockets, the hood being made of acrylic pile.

12. A flexible tool pouch for use in carrying, storing, and protecting hand tools as defined in claim 11, wherein each pocket incrementally increases in length.

13. A flexible tool pouch for use in carrying, storing, and protecting hand tools as defined in claim 11, the tool pouch further comprising an eyelet attached to the hood for hanging the tool pouch.

14. A flexible tool pouch for use in carrying, storing, and protecting hand tools as defined in claim 11, wherein the outside liner comprises a front panel and a rear panel, the rear panel being connected to the hood to define a back panel, the back panel having an inside edge and an outside edge.

15. A flexible tool pouch for use in carrying, storing, and protecting hand tools as defined in claim 14, further comprising an inside handle strap being attached to the inside edge of the back panel and an outside handle strap being attached to the outside edge of the back panel.

16. A flexible tool pouch for use in carrying, storing, and protecting hand tools as defined in claim 14, further comprising a pair of tieing straps attached to the back panel.

17. A flexible tool pouch for use in carrying, storing, and protecting hand tools as defined in claim 14, further comprising hook & loop attached to the back panel.

18. A flexible tool pouch for use in carrying, storing, and protecting hand tools as defined in claim 14, further comprising a secondary pocket attached to the front panel, the secondary pocket having:

i) an inside liner made partially of woven nylon, ii) an outside liner made of acrylic pile, and iii) a mouth positioned at one end of the secondary pocket.

19. A flexible tool pouch for use in carrying, storing, and protecting hand tools, the flexible tool pouch comprising:

a) a flexible rectangular back panel, the back panel made of acrylic pile, the back panel having an interior surface, an exterior surface, a base edge, a top edge, an inside edge, and an outside edge;

b) a flexible back panel liner made of woven nylon and having a base edge, a mouth edge, an inside edge, and an outside edge, the back panel liner being secured to the interior surface of the back panel with the base edge, inside edge, and outside edge of the back panel and back panel liner being complementary aligned;

c) a front panel liner made of woven nylon and having a shape complementary and aligned with the back panel liner; and d) a front panel made of acrylic pile and having a shape complementary to the back panel liner, the front panel also having an interior surface, an exterior surface, an attachment edge, and a receiving edge, the interior surface of the front panel being complementarily aligned with and secured to the front panel liner and the attachment edge being secured to the back panel, thereby forming a pocket having interior walls defined by the front panel liner and the back panel liner with a mouth positioned along the receiving edge of the front panel.

* * * * *